United States Patent [19]

Shank

[11] 4,081,885

[45] Apr. 4, 1978

[54] METHOD OF MAKING A TEXTILE PRODUCT

[76] Inventor: Lee R. Shank, 18211 N. 35th Ave., Phoenix, Ariz. 85032

[21] Appl. No.: 719,459

[22] Filed: Sep. 1, 1976

[51] Int. Cl.[2] ..... D04D 7/04

[52] U.S. Cl. ..... 28/149

[58] Field of Search ..... 26/8 R; 28/149, 15, 28/2

[56] References Cited

U.S. PATENT DOCUMENTS

| | | | |
|---|---|---|---|
| 1,361,055 | 12/1920 | Henry | 28/15 |
| 2,065,185 | 12/1936 | Jones | 26/8 R |

*Primary Examiner*—Louis K. Rimrodt

[57] ABSTRACT

A method of making a textile product. In the preferred form a rectangular loom is utilized. The strands of string are applied transversely between opposite sides of the loom forming a gridlike backing web. Then yarns which may be colored are extended transversely between opposite sides of the loom in alignment with the strands of the web. From the opposite side of the web, as formed, the intersections of the strands of string and overlying yarns are secured together by being tied preferably by way of clove hitches. Then an implement in the form of a stiff member is passed between backing web and adjacent runs of yarn and then yarns that are transverse to the said member are cut midway between the intersections. All the yarns are cut in this way. Cut yarns then form rosettes. The ends of transverse strings are then tied to hold the rosettes at the ends in place and fringes or tassles may be formed along the edges of the articles after removal from the loom.

1 Claim, 18 Drawing Figures

FIG. 1
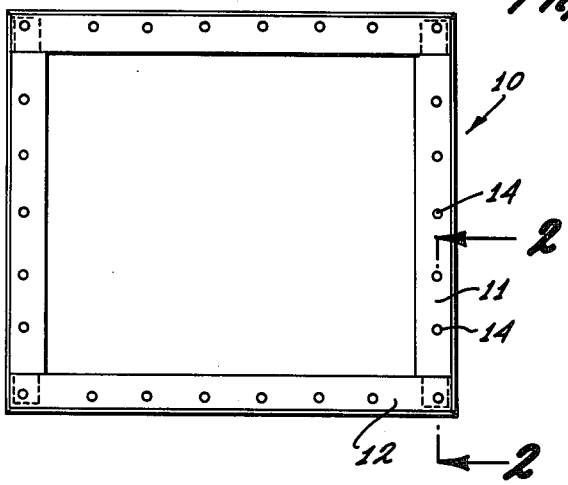
FIG. 2
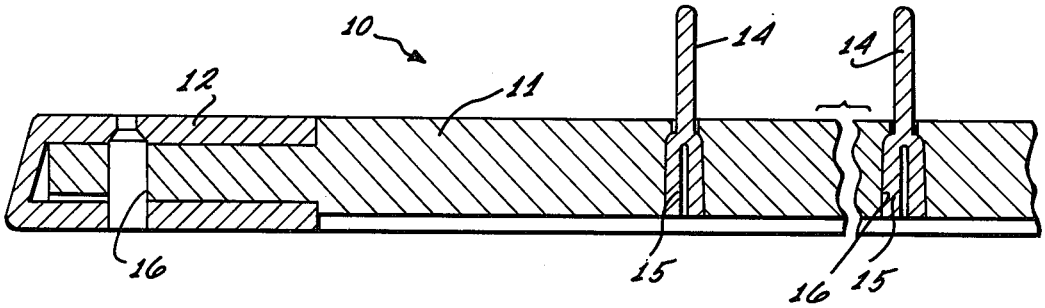
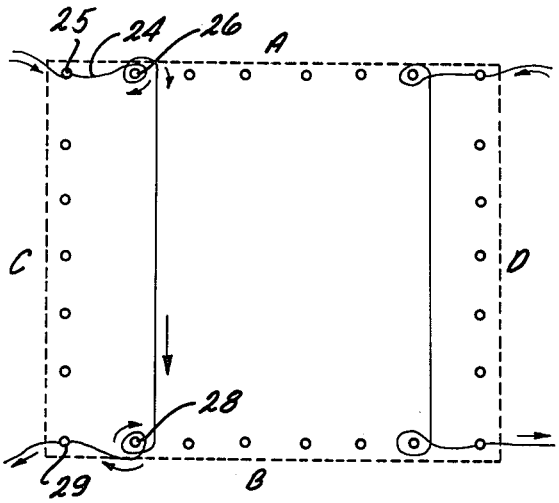
FIG. 3
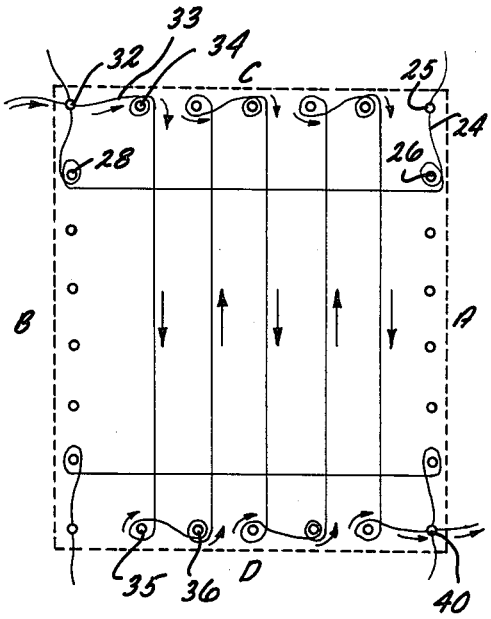
FIG. 4

Fig. 10
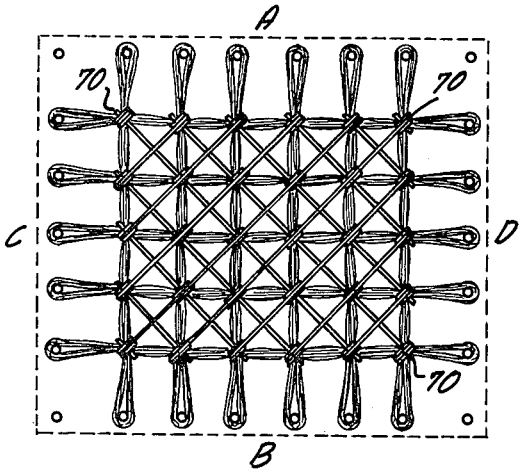
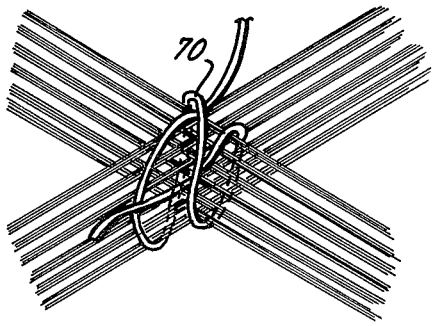
Fig. 11
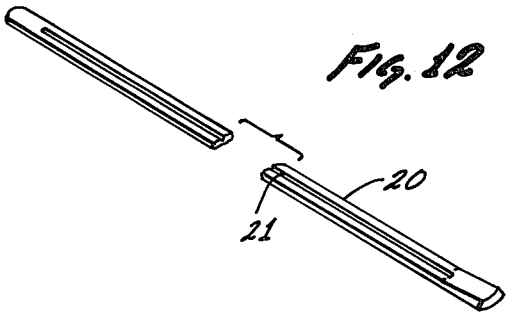
Fig. 12
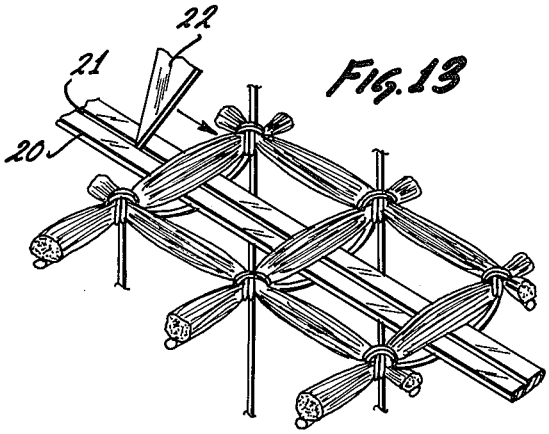
Fig. 13
Fig. 14
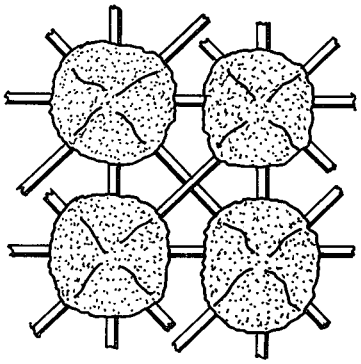
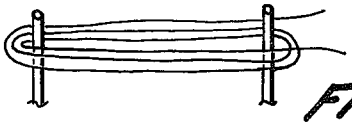
Fig. 15
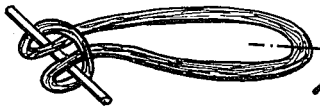
Fig. 15a
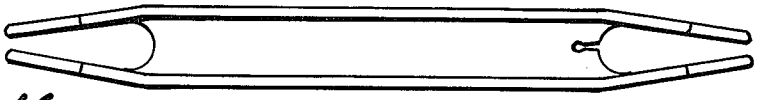
Fig. 16
Fig. 16a
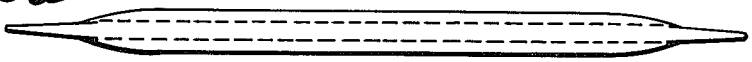

METHOD OF MAKING A TEXTILE PRODUCT

BACKGROUND OF THE INVENTION

1. Field of the Invention

The field of the invention is that of creation by weaving of a particular textile product. Very simple materials are utilized as described hereinafter. The parts utilized and the technique are particularly designed to adapt the invention to appear as a kit for the hobby/craft market, as made more clear hereinafter. The technique embodies the type of weaving producing a textile article of a unique texture as made more clear hereinafter.

2. Description of the Prior Art

It is, of course, well known in the prior art to provide a rectangular loom with strand holding means and to fix strands positioned in both directions relative to the loom. Such typical construction may be illustrated in a number of patents, including U.S. Pat. Nos. 1,154,644; 1,794,312; 2,011,916; 2,118,142; 2,159,265; 2,186,692; 2,229,188; 2,481,955; 2,780,854; and 3,054,429. It has also been known in the prior art to provide a loom and means for securing strands running transversely in both directions between opposite sides of the loom and to further provide tying means to tie the respective transverse strands together at the intersections. The forming of rosettes, or yarn balls at the intersections has also been done in the prior art. Patents showning these features include U.S. Pat. No. 61,385; 427,769; and 1,446,316. The patents identified herein do not, however, disclose the specific creative technique and specific combination of materials utilized in the technique of the present invention as described in detail hereinafter.

SUMMARY OF THE INVENTION

The invention as referred to in the abstract relates to a technique involving weaving yarn for producing a particular unique textile product. The materials utilized in the invention and the technique itself are of a particular simplified nature ideally adapting the invention to utilization in the form of a kit for the hobby/craft market. The craft enthusiast can make a completely new type of weaving with a unique texture which texture is adaptable for a variety of uses such as for example pillows, drapes, bedspreads, purses, etc.

In the exemplary form of the invention as described in detail herein, a rectangular loom is utilized provided with pegs along the sides. A backing web is first constructed by the carrying strands of string transversely between the opposite sides of the loom forming squares. Yarns which may be of one color or more than one color are then strung or woven between the pegs on opposite sides of the loom in both directions in a position overlying the web already formed. The yarns may comprise multiple strands and different colored yarns may be utilized depending upon the particular results desired.

Then working from the opposite side of the loom and again using string and working along diagonal lines, ties are made tying the yarns to the intersections of the strings of the backing web. Preferably the ties are made by way of clove hitches. Then an implement which is identified as a cutting stick is slipped between strings of the backing web and the yarns are cut along lines midway between transverse strings of the web. This results in the formation of yarn balls or rosettes at the tied intersections of the backing web and the yarns. Further details of the exemplary embodiment are described in detail hereinafter.

In the light of the foregoing, the primary object is to provide an improved and unique technique or method for creating by weaving on a loom a unique textile product.

A further object is to realize a unique textile product which results from the method or technique which is a product having a backing web formed of strings with yarn rosettes fastened to the backing web being tied to it at the intersections of the web strings, the textile product having a unique texture highly adapting it for a variety of uses as set forth in the foregoing.

A further object is to realize a product as set forth in the foregoing which is highly decorative, unique in appearance, and highly desirable as a textile product.

A further object is to provide a method or technique including the steps as set forth in the foregoing and including tying yarns overlying the strings of the backing web, tying the yarns to the intersections of the backing web strings, inserting a spacer between strings of the backing web and the yarns and cutting the yarns along lines midway between the transverse cuttings of the backing web.

Further objects and additional advantages of the invention will become apparent from the following detailed description and annexed drawings.

BRIEF DESCRIPTION OF THE DRAWINGS

FIG. 1 is a plan view of an exemplary form of loom used in the practice of the invention;

FIG. 2 is a sectional view taken along the line 2—2 of FIG. 1;

FIGS. 3, 4, and 5 are illustrative views, illustrating the placement or weaving of the transverse strings that form the backing web;

FIG. 9 is an illustrative view, illustrating the finally positioned yarns overlying the strings of the backing webs;

FIG. 10 is an illustrative view of the back side of the loom, illustrating the diagonal tying together of the intersections of the strings of the backing web and the yarns;

FIG. 11 illustrates the tying together of strings and yarns at the intersections, preferably by way of a clove hitch;

FIG. 12 illustrates the slotted cutting stick utilized for cutting the yarns;

FIG. 13 is an illustrative view illustrating cutting of the yarns;

FIG. 14 is an illustrative view showing the horizontal yarns after being cut;

FIGS. 15 and **15*a*** are illustrative views showing the formation of fringe.

FIGS. 16 and **16*a*** show the needle shuttle.

DESCRIPTION OF THE PREFERRED EMBODIMENT

As previously indicated it is preferred to assemble the materials to be utilized in practicing the invention in the form of a kit for the hobby/craft market.

In this overindustrialized age when everyone longs for the charm and homliness of an earlier day, more and more people are finding out that there is nothing to match the satisfaction of "making it yourself".

A creative hobby such as that offered by the herein invention helps to develop latent skills, talents, and abilities by finding expression for them and putting them to work. It gives the hobbiest the opportunity to explore and find new methods of learning about the field in which he is interested.

Crafts are hobbies with a touch of practicability. Half the fun is in creating things of beauty from raw materials, the other half is in using the finished products for home decorating as gifts or otherwise. The herein invention meets this need.

The materials required for practice of the invention are very simple, including a simple weaving loom with pegs; parcel post string, 8-ply and 10-ply; acrylic yarn in desired colors; a needle shuttle; a cutting stick; a cutting knife; and a nylon bristle brush. Preferably the materials and instructions are packed in a kit.

FIG. 1 shows an exemplary form of loom as designated at 10 which may preferably be formed from plastic injection molded pieces. Side members may have the configuration as illustrated at 11 in FIG. 2 and other side members constructed as designated by numeral 12 to provide for a dovetailed relationship at the corner joints. Pins or prongs are provided as designated for example at 14 having enlarged lower ends which are split as shown and as designated at 15 to be received in openings of the type as designated at 16. The loom itself can be of widely different types of construction.

The physical parts that would be included in a kit for practicing the invention includes parcel post string, 8-ply for cross ties and 10-ply for base strings. The acrylic yarn is in colors of four ply. The needle shuttle is not shown since it can be conventional. Numeral 20 in FIG. 12 designates the cutting stick as a flat strip of material such as plastic with an elongated slot along the center as designated at 21. The utilization of the stick will be described hereinafter. The tip of the blade of the cutting knife is shown at 22 in FIG. 13. It may be a known form of knife. The nylon bristle brush can be a conventional item.

Figure 5:
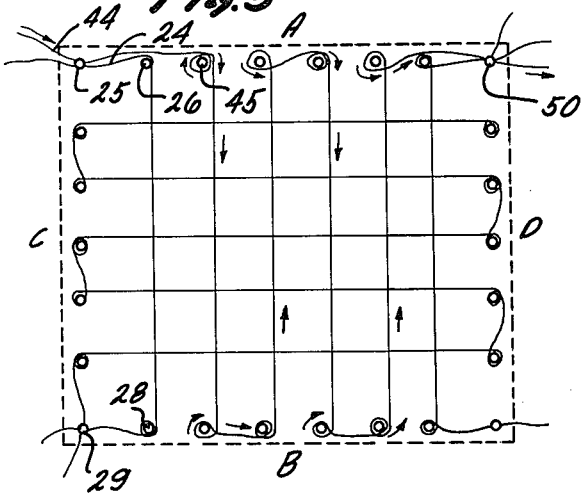

The first steps in the process or technique of the invention include the stringing of the loom, that is, making or preparing the net or web of base strings. For purposes of illustration the sides of the rectangular frame or loom are identified by the characters A, B, C, and D in the figures. The first steps are illustrated in FIGS. 3, 4, and 5. Using a clove hitch and preferably leaving a 2-inch tail, the string 24 is tied onto a corner locking peg between sides A and C as shown in FIG. 3. The cord is wrapped once clockwise around peg 26 on side A as shown and then runs straight down towards peg 28 on side B. The string 24 is then taken to the locking peg 29 and tied off preferably with a clove hitch and cut leaving a 1½ inch tail. The same procedure is taken on the opposite side as illustrated in FIG. 3 maintaining clockwise wrapping. This provides the first two base strings, the string on side D being like and symmetrical to the string on side A similarly configurated.

FIG. 4 illustrates the stringing between the sides C and D. Leaving 2-inch tail, a clove hitch is made on corner peg 32 with string 33 which is then wrapped clockwise around peg 34 and then taken down around peg 35 and continued counterclockwise around the next peg 36. This is repeated until sides C and D are fully strung as illustrated in FIG. 4. To the extent that strands between side pegs are the same and/or symmetrical they need not be further described in detail. String 33 is tied off at peg 40 as shown.

In order to realize or achieve uniform squares a string is wound from outside to inside of the pegs alternately as may be seen in FIG. 4.

The procedure continues as illustrated in FIG. 5. String 44 is tied onto peg 25 and it then bypasses peg 26 and is wrapped clockwise around peg 45. This technique of stringing is continued across the rest of the loom and string 44 is then tied off at locking peg 50. The string is cut off leaving a 2-inch tail.

Figure 6:
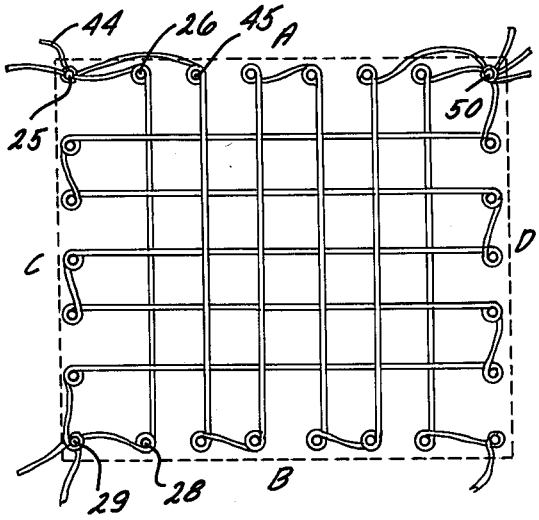
FIG. 6 is an illustrative view, illustrating the completed backing web formed of strings.

FIG. 6 illustrates the fuly strung loom, that is with a web formed of strings having intersections providing squares.

Figure 7:
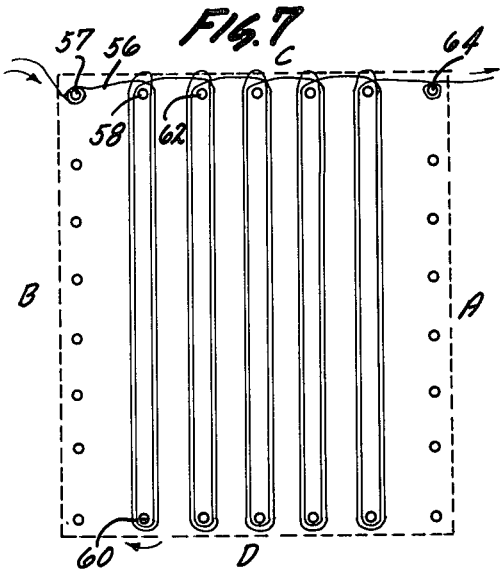
FIGS. 7, 8, and 9 are illustrative views, illustrating the placement or weaving the yarns between opposite sides of the loom overlying the backing web.

The next part of the procedure is the placement or stringing of the yarns preparatory to making the "snowball" designs or rosettes. The desired color of yarn is selected, or a combination of colors, the initial procedures being illustrated in FIG. 7. Leaving a 2-inch tail of yarn 56, it is tied to locking peg 57 and it is then laced twice clockwise around pegs 58 and 60 on sides C and D and then crossed to the next peg 62 on side C. These steps are repeated on each of the pegs across the loom as illustrated. The yarn is tied off at peg 64.

Figure 8:
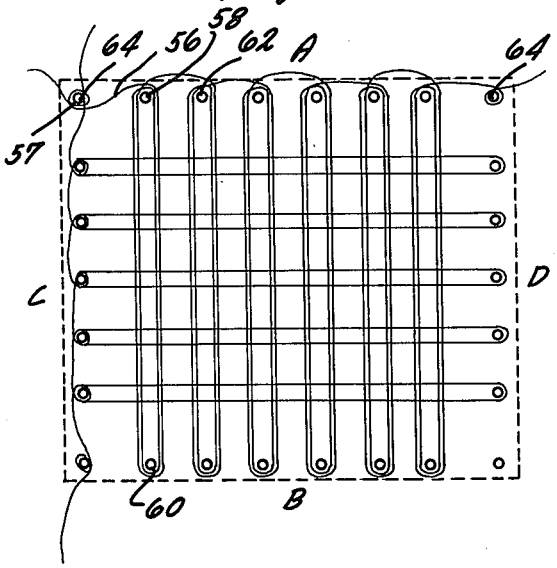

Using only one color of yarn the procedure is continued as illustrated in FIG. 8 and is not after tying off at peg 64 a yarn of another color is tied onto peg 64 and similarly laced between sides C and D.

The above described procedure is continued placing four strands around each peg until there are 16 strands of yarn by way of example, laced on each peg in each direction. The technique for the exemplary embodiment for 1½ inch balls or rosettes is continued until there are 24 strands of yarn in each direction.

In lacing, the layers of yarn are alternated to form a weave as illustrated in FIG. 8. Preferably yarns are always laced clockwise from left-to-right across the loom or frame rotating the loom counterclockwise as it is necessary to do this. If more than one color of yarn is being used, for example up to three colors, the colored strands may be combined and laced at the same time but preferably laced only once around at a time rather than twice.

Figure 9:
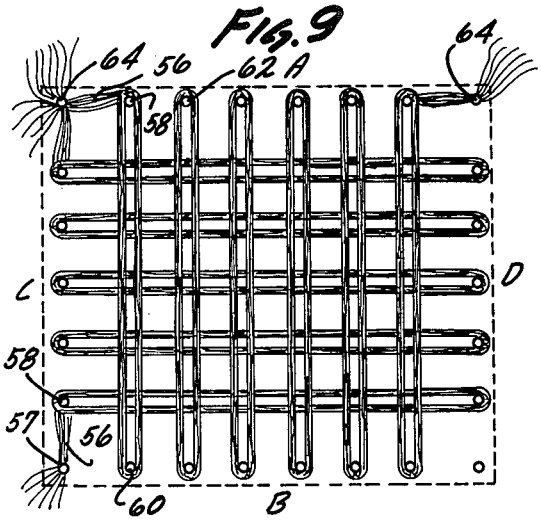

FIG. 9 illustrates the loom with the lacing of the yarns completed as described in the foregoing.

Next will be described the tying intersections of strings and yarns. First, a needle shuttle is threaded with as much 8-ply string, for example, as it will hold. Using the needle shuttle a string knot which by way of example may be a clove hitch is made around the lacing at each corner of the loom as illustrated at 70 of FIG. 10. A 3-inch tail is left on the string, if additional webs are to be joined together. Otherwise, a ¼-inch tail may be left. Each intersection is illustrated in FIG. 11 and tied with a knot which may be a clove hitch beginning with one of the corners already tied as illustrated at 70 and then the process is continued diagonally across the frame or loom as illustrated in FIG. 10. FIG. 11 is a detail illustration of the tying of an intersection of strings and yarns by way of a knot with preferably a clove hitch. The process is continued diagonally to the opposite end as illustrated and a 3-inch tail is left if additional webs are to be joined together. Preferably, then the loom is rotated counterclockwise and the process is begun in the lower left corner, the ties made diagonally across the frame. The process is continued tying off each intersection from lower left to upper right in one direction at a time. The loom is rotated as necessary with the tying repeated until all intersections are tied as shown in FIG. 10. This also assures even pull of the web.

It is possible to construct two or more backing webs which can be joined together, and, if this is done, preferably a 3-inch tail is left at the end of the string at the beginning and end of each cross tie.

The next part of the procedure is that of cutting the yarns to provide the yarn balls or rosettes. This procedure is illustrated in FIGS. 12 and 13. The cutting stick 20 at the reverse side of the loom is slid between base string with the yarn overlying it as illustrated, that is the yarn is then on one side of the cutting stick and the base string and cross ties are on the other side as shown. The cutting stick is slid to the center and then the loom is turned over so that the yarn is on top and then the yarn only is cut with a cutting knife exactly in the center between the tie web intersections without cutting the base string, the cut being made along the groove 21 in the cutting stick. The cutting is repeated in this manner all the way across the loom. The result appears as in FIG. 14, showing part of the base web, and the cut yarns. It is preferable to begin cutting in the center of the web and continuing outwardly from the center to the edges. Preferably the cuts are made alternately on opposite sides of the center to keep even pressure on the web. If only one or a single web is to be made a last cut between pegs and the first roll of the balls on all four sides is not made.

FIG. 14 illustrates the appearance of the product after all of the cuts have been made in both directions so that the yarn form balls, "snowballs" or rosettes at the intersections as illustrated. The yarns at the intersections are assisted into the formation of balls or rosettes by brushing up the yarn from all sides of the nylon bristle brush.

To remove the product from the loom, that is to slip the web clear off the loom, scissors are used to cut the yarn and string between the pegs.

The technique of the invention offers a number of possibilities that have been referred to and are apparent from the foregoing description and which greatly enhance the quality of the invention as a hobby/craft product.

With respect to the technique and the finished textile product as so far described, there are certain particular variations or embodiments. In a first variation the product includes a single backing or web as described. The loops at the sides are cut to provide a fringe and then to insure that the balls or rosettes on the outer perimeter are secure all the base strings are tied with a double knot back around itself on the underside of the ball. The base strings are tied off with diagonal cross ties to ¼ inch.

In a further variation or form of the invention, two or more backing webs may be utilized. First a web is turned over and the two webs are brought up against each other. All base strings around the edges are tied off and then an overhand knot is made to insure holding the work firmly. The knots should be as close to the balls or rosettes as possible. The cross ties are tied with the same knots having a ¼ inch tail.

A border fringe may be made in the following way. The yarn is strung to desired fringe lengths on pegs about eight times, for example. Then the yarn is taken off the pegs and put over the finger of the operator. Then working from the reverse side of web the yarn is put through the base string between balls on the outer edge when the yarn is slipped through a loop formed of the yarn to the top and tightened on the base string. The loop is cut to make the fringe. See FIGS. 15 and 15*a*.

From the foregoing those skilled in the art will readily understand the nature of the process or technique of the invention and the characteristics of the resulting product. The detailed description also makes it clear how all of the objects of the invention are realized and its characteristics achieved. The invention has very high hobby/craft value and ideally adapts itself to this utilization to be marketed in the form of a kit.

The foregoing disclosure is representative of preferred forms of the invention and is to be interpreted in an illustrative rather than a limiting sense the invention to be accorded the full scope of the claims appended hereto.

What is claimed is:

1. A method of making a textile article comprising the steps of forming a backing web by positioning textile strands transversely between the sides of the loom, extending multiple strands of yarn between the sides of the loom in alignment with the textile strands, providing securements of the yarn strands to the textile strands at the intersections thereof, including the step of providing the securements at the said intersections by way of strings extending diagonally between intersections, cutting the yarn strands between secured intersections while leaving the web backing and diagonal strings intact whereby the cut strands of yarn can form rosettes, including the step of inserting a cutting stick in a longitudinal position between parallel aligned yarn strands on one side and textile strands and diagonal strings on the other, and cutting yarn strands by moving a cutting blade along said stick without cutting the textile strands and diagonal strings and guiding the blade solely by holding it against an edge surface on the cutting stick.

* * * * *